United States Patent [19]

Takagi et al.

[11] 4,309,499

[45] Jan. 5, 1982

[54] FORMATION OF BLACK-AND-WHITE SILVER-CONTAINING NEGATIVE IMAGES BY A DIFFUSION TRANSFER PROCESS

[75] Inventors: Yoshihiro Takagi; Katsumi Hayashi, both of Minami-ashigara, Japan

[73] Assignee: Fuji Photo Film Co., Ltd., Kanagawa, Japan

[21] Appl. No.: 94,396

[22] Filed: Nov. 14, 1979

[30] Foreign Application Priority Data

Nov. 14, 1978 [JP] Japan ..... 53/140099

[51] Int. Cl.[3] ..... G03C 5/54

[52] U.S. Cl. ..... 430/250; 430/230; 430/244; 430/249; 430/251; 430/409; 430/410

[58] Field of Search ..... 430/244, 249, 251, 230, 430/409, 250, 410

[56] References Cited

U.S. PATENT DOCUMENTS

| | | | |
|---|---|---|---|
| 2,543,181 | 2/1951 | Land | 430/227 |
| 2,861,885 | 11/1958 | Land | 430/229 |
| 3,615,438 | 10/1971 | Land | 430/251 |
| 3,649,270 | 3/1972 | Blake | 430/249 |
| 3,733,199 | 5/1973 | Crough et al. | 430/406 |
| 3,923,513 | 12/1975 | Evans | 430/409 |
| 4,144,064 | 3/1979 | Vermeulen | 430/244 |

*Primary Examiner*—Richard L. Schilling

*Attorney, Agent, or Firm*—Sughrue, Mion, Zinn, Macpeak & Seas

[57] ABSTRACT

A black-and-white negative image forming process is disclosed using a diffusion transfer type film unit. An exposed silver halide emulsion comprising internal latent image type silver halide grains which have substantially no fogging centers at their surface is processed with a composition comprising a silver halide solvent, a developing agent, a foggant, alkali and a fog promoting agent. The solvent for the silver halide characteristically possesses a solubilizing power for AgBr of from about $2\times10^{-5}$ to $5\times10^{-3}$ mol/l in a 0.002 molar aqueous solution.

11 Claims, No Drawings

FORMATION OF BLACK-AND-WHITE SILVER-CONTAINING NEGATIVE IMAGES BY A DIFFUSION TRANSFER PROCESS

BACKGROUND OF THE INVENTION

1. Field of the Invention

This invention relates to a method of forming an optically negative black-and-white silver image and, in particular, to a highly sensitive method of forming images using internal latent image type silver halide emulsions in which the grain surface is not intentionally fogged.

2. Description of the Prior Art

Formation of black-and-white images by means of a diffusion transfer process has long been applied to monochromatic instant photography. A representative method provides black-and-white positive silver images in the image-receiving layer of a film unit comprising a transparent support, an ordinary negative type silver halide emulsion layer coated thereon, and an image-receiving layer containing physical development nuclei (physical development centers) provided on a separate support, for example, paper, etc. After imagewise exposure, a developer containing a solvent for the silver halide such as a thiosulfate is expended between the silver halide emulsion layer and the image-receiving layer. The process can be dissected into three steps: (1) instantaneous development of a negative-type silver halide emulsion in the exposed areas to completion (insolubilization of the exposed areas), (2) dissolution and diffusion of the unexposed silver halide grains in the form of a soluble silver salt (dissolution of the unexposed areas), and (3) reduction of the dissolved silver salt in the image-receiving layer by the catalytic function of the physical development nuclei therein. The details of the process can be found in, for example, *Photographic Silver Halide Diffusion Process* by A. Rott and E. Weyde, 1972, The Focal Press, etc.

Likewise, photographic diffusion transfer processes providing negative black-and-white images are also known. For example, U.S. Pat. No. 3,615,438 and *Photographic Science and Engineering,* Vol. 15 (1), pp. 4–20 (1971) disclose a so-called solubilizing process which provides negative black-and-white images in the image-receiving layer by processing a typical nega-type silver halide emulsion with a processing formulation comprising a solvent for the silver halide and a heterocyclic compound containing a mercapto group whereby the degree of dissolution of the silver halide is appropriately controlled depending on the amount of exposure to produce a negative silver image. However, this solubilizing process suffers from a very narrow exposure latitude because the image tends to reverse at higher exposures. The exposure latitude is so narrow as to impose a severe restriction onto practical picture-taking conditions. Further, the presence of a development suppressing agent at a high concentration in the developer unacceptably lengthens the development period; and still another disadvantage is a keen dependence of the development results on the temperature during development.

Another process for obtaining negative black-and-white images based on diffusion transfer utilizes direct reversal type silver halide emulsions as is disclosed in U.S. Pat. No. 3,733,199. Such direct reversal type silver halide photographic emulsions include the so-called Herschel direct reversal type emulsions which are uniformly fogged prior to image exposure, and core-shell type direct reversal type emulsions in which the surface portion of each grain constituting the shell structure is fogged, as is disclosed in U.S. Pat. No. 3,367,778. Unfortunately, however, such direct reversal type silver halide emulsions have very low photographic speeds, which makes the above process very disadvantageous.

SUMMARY OF THE INVENTION

Accordingly, one object of the instant invention is to provide a diffusion transfer photographic process capable of forming negative black-and-white images without accompanying disadvantages cited above.

Another object of the present invention is to provide a diffusion transfer process for forming silver-containing images with higher photographic speed.

Still another object of the present invention is to provide a diffusion transfer process for forming negative silver-containing images in an image-receiving layer with wide exposure latitude.

The objects of the present invention have been achieved using a black-and-white image forming diffusion transfer photographic film unit comprising a support, a silver halide photographic emulsion layer and an image-receiving layer, wherein the unit is processed after imagewise exposure in the presence of a solvent for the silver halide, a developing agent, a foggant, a fogging promoting agent and an alkaline compound. The silver halide photographic emulsion is of an internal latent image type emulsion without surface fogging (i.e., having no surface fogging centers), and the solvent for the silver halide is able to dissolve silver bromide in a concentration range of from about $2\times10^{-5}$ to about $5\times10^{-3}$ mol/l, and more preferably from about $5\times10^{-5}$ to about $2\times10^{-3}$ mol/l when used in the form of a 0.02 molar aqueous solution at 60° C. and at the developing pH.

DETAILED DESCRIPTION OF THE INVENTION

The negative black-and-white images of the present invention can be favorably recorded with higher photographic speeds as compared with those obtained using the direct reversal type emulsions set forth in U.S. Pat. No. 3,733,199 using a Herschel type developer. Internal latent image type photographic emulsions having no surface fogging centers do not provide black-and-white silver images in the image-receiving layer when processed with a formulation containing a solvent for silver halide having high solubility such as sodium thiosulfate as described in U.S. Pat. No. 3,733,199 because the silver halide grains start to dissolve before the development of the unexposed grains has proceeded to a sufficient extent. Nevertheless, it has been found that even with such an internal latent image emulsion, a black-and-white negative image comprising silver can be successfully formed in the image-receiving layer using a foggant and a fogging promoting agent together with a solvent for silver halide having the defined solvent strength because these combinations of the foggant, fogging promoting agent and the silver halide solvent do not obstruct the nucleating development (i.e., fogging development). This finding is the basis of the present invention.

The internal latent image type silver halide photographic emulsion in which the grain surfaces do not have fog centers used in the present invention is defined by the fact that the internal sensitivity of the silver halide grains is higher than the surface sensitivity. Such silver halides are described in U.S. Pat. Nos. 2,592,250, 3,206,313, 3,317,322, 3,511,662, 3,447,927, 3,761,266, 3,736,140 and 2,592,250, etc. As each of the above cited U.S. patents disclose, the internal latent image type silver halide photographic emulsion without surface fog centers can be prepared by covering the surface of grain cores comprising chemically sensitized silver halide with a layer comprising chemically unsensitized silver halide, or by blending a chemically sensitized coarse grain silver halide emulsion with a chemically unsensitized fine grain emulsion whereby surface deposition of the latter composition on the former occurs.

An internal latent image silver halide emulsion can be more specifically defined as an emulsion which gives a higher maximum density with an internal type developer than the maximum density with a surface type developer. Generally, the internal latent image silver halide emulsions suited for the present invention when tested according to normal photographic sensitometric techniques by coating a test portion of the emulsion on a transparent support, exposing to an optical wedge for a fixed time interval between 0.01 and 1 second, and developing for about 3 minutes at 20° C. in Developer A below, an internal latent image developer, have a maximum density greater than the maximum density of an identical test portion which has been exposed in the same way and developed for 4 minutes at 20° C. in Developer B below, a surface-type developer. Preferably, the maximum density in Developer A is at least about 5 times, and more preferably about 10 times greater than the maximum density in Developer B.

| | |
|---|---|
| Developer A | |
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1 l |
| Developer B | |
| p-Oxyphenylglycine | 10 g |
| Sodium Carbonate | 100 g |
| Water to make | 1 l |

Conventional silver halide compositions can be used in the present invention. Some representative examples thereof include silver chloride, silver, chlorobromide, silver bromide, silver iodobromide, silver chloroiodobromide or mixtures thereof.

A distinguishing feature of the present invention lies in the formation of a negative image in the image-receiving layer by performing after imagewise exposure a surface fogging development of one of the above-described internal latent image type silver halide emulsions with no surface fog centers.

The developer used for the present invention contains a developing agent, an alkali, a solvent for the silver halide, a foggant, and a fogging promoting agent, and optionally a thickener, etc. Among these ingredients, however, the foggant can be incorporated in the photosensitive material or in both of the photosensitive material and the developer.

Foggants used in the present invention are compounds capable of preferentially fogging at the surface of the silver halide grains having no internal latent image (internal development nuclei) during a development processing or a pre-bath processing thus making such grains developable with a surface type developer and, on the other hand, do not form surface development centers in silver halide grains already having internal latent images. Suitable compounds used as the foggant of the present invention include boron hydride compounds (for example, $KBH_4$, etc.), Sn compounds (for example, $SnCl_2$, etc.), the hydrazine derivatives described in U.S. Pat. Nos. 2,588,982 and 2,568,785 (for example, hydrazine dihydrochloride , p-tolylhydrazine hydrochloride, p-nitrophenylhydrazine hydrochloride, phenylhydrazine hydrochloride, diamino biuret, etc.), the hydrazides as described in U.S. Pat. No. 3,227,552 (for example, 1-formyl-2-phenylhydrazide, 1-acetyl-2-phenylhydrazide, 1-phenylsulfonyl-2-phenylhydrazide, etc.), the hydrazones as described in U.S. Pat. No. 3,227,552, the hydrazone quaternary salts described in U.S. Pat. No. 3,615,615 (for example, 3-(2-formylethyl)-2-methylbenzothiazolium bromide, etc.), the hydrazines containing a thiourea group described in U.S. Pat. Nos. 4,030,925 and 4,031,127 and Japanese patent application No. 142469/77 (corresponding to U.S. patent application Ser. No. 961,827, filed Nov. 17. 1978) (for example, 1-[4-(2-formylhydrazino)phenyl]-3-methylthiourea, 1-[3-(2-formylhydrazino)-phenyl]-3-phenylthiourea, 1-[4-(2-formylhydrazino)phenyl]-2-phenylthiourea, 1-[3-N-(4-formylhydrazino-phenyl)carbamoylphenyl]-2-phenylthiourea, etc.), etc., and mixtures thereof. Typical examples of the compounds favorably used in the present invention as foggant are listed below. The present invention is not limited to the use of these compounds alone.

F-1 1-[3-N-(4-formylhydrazino-phenyl)carbamoyl-phenyl]-2-phenylthiourea
F-2 1-[4-(2-formylhydrazino)phenyl]-2-phenylthiourea
F-3 phenylhydrazine
F-4 p-tolylhydrazine
F-5 p-nitrophenylhydrazine
F-6 hydrazine
F-7 $KBH_4$
F-8 $SnCl_2$ The amount of the foggant can vary over a relatively wide range depending on its selection and the effect desired. Generally, when the foggant is incorporated in the photosensitive material, its concentration is from about 50 to 1,500 mg/mol Ag, and preferably from about 300 to 600 mg/mol Ag. When the foggant is present in the developer, it is used in an amount of about 0.05 to 5 g, and more preferably about 0.1 to 1 g per 1 liter of the developer.

In practicing the present invention fogging development must be completed before the dissolution of the silver halide proceeds. For this reason, on the one hand, the developer contains a fogging promoting agent and, on the other, a silver halide solvent which exerts a relatively weak dissolving power. Those solvents which are preferred are solvents that when used as a 0.02 molar aqueous solution dissolve AgBr in a concentration range of from about $2\times10^{-5}$ to $5\times10^{-3}$ mol/l, and more preferably from about $5\times10^{-5}$ to $2\times10^{-3}$ mol/l at 60° C. The dissolving power defined above does not need to be available over the entire pH range but only for the specific range in which the solvent is used. For example, those solvents which exhibit the above-defined solubilizing strength only at a pH of about 11 may be used. In this regard it is also noted that reference to AgBr is only to define the dissolving power of the silver halide solvent and in no way restricts the silver halide compositions which may be used. Suitable silver halide solvents for use in the present invention include thioethers (for example, $HO\text{-}CH_2CH_2SCH_2CH_2OH$, $HO\text{-}CH_2CH_2SCH_2CH_2SCH_2CH_2OH$, $HO\text{-}CH_2CH_2CH_2SCH_2CH_2SCH_2CH_2CH_2OH$, $HOCH_2CH_2SCH_2CH_2SCH_2CH_2SCH_2CH_2OH$, $$HOCH_2\underset{\underset{OH}{|}}{C}HCH_2SCH_2CH_2SCH_2\underset{\underset{OH}{|}}{C}HCH_2OH,$$

$H_2NCH_2CH_2SCH_2CH_2SCH_2CH_2NH_2.2HCl$, $HOCH_2CH_2SCH_2CH_2OCH_2CH_2SCH_2CH_2OH$, $C_2H_5OCH_2CH_2SCH_2CH_2OCH_2CH_2SCH_2CH_2OC_2H_5$, etc.), thioureas (for example,

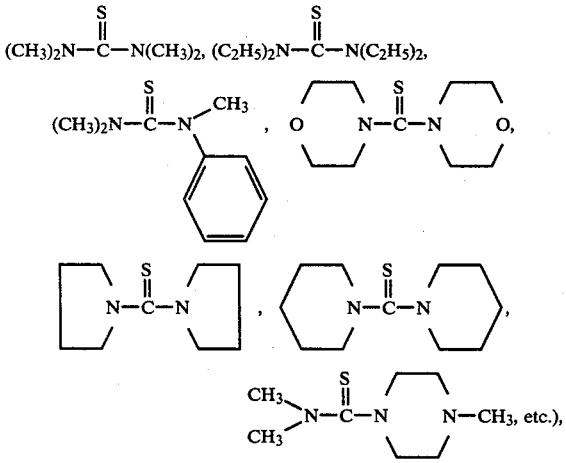

thiazolines (for example,

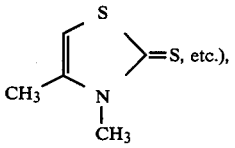

cyclicimides (for example,

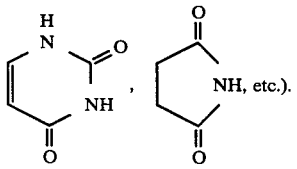

Of the foregoing, the following compounds are particularly preferred:

S-1 $HOCH_2CH_2SCH_2CH_2OH$

S-2 $HOCH_2CH_2SCH_2CH_2SCH_2CH_2OH$

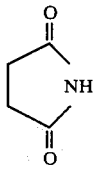

S-3

-continued

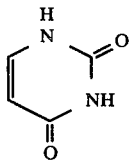

S-4

$$HOCH_2\overset{\overset{OH}{|}}{C}HCH_2SCH_2CH_2SCH_2CH_2SCH_2\overset{\overset{OH}{|}}{C}HCH_2OH$$

S-5

The silver halide solvent is preferably added in an amount of from about 1 to 60 g, and more preferably about 10 to 40 g per liter of the developer.

The fogging promoting agent promotes the action of the foggant and, thereby, unexposed silver halide is effectively fogged and thus the contrast between exposed area and unexposed area is improved. Suitable fogging promoting agents used in the present invention include benzotriazoles such as benzotriazole, 5-methylbenzotriazole, 1-phenyl-5-mercaptotriazole, etc., benzoindazoles such as 5-nitrobenzoindazole, 6-nitrobenzoindazole, etc., triazaindolidines such as 5-methyl-7-hydroxy-1,3,4-triazaindolidine, etc., benzimidazoles such as 2-mercaptobenzimidazole, etc., benzoxazoles, oxazoles such as 2-mercapto-5-methyloxazole, etc., pyrimidines such as 2-mercapto-4-hydroxy-6-methylpyrimidine, etc., pyrazoles, pyrazolones, indazolones, thiazoles such as 2-mercapto-3,4-dimethylthiazole, etc., benzothiazoles, amines such as diethylamine, N-(2-mercaptoethyl)-N,N-diethylamine, N-(2-mercaptoethyl)-N,N-dimethylamine, etc., thiadiazoles such as 2-mercapto-5-aminothiadiazole, etc., as described in U.S. Pat. Nos. 2,497,917, and 3,352,672 and *Research Disclosure*, No. 15162 (1976). Fogging promoters like 5-methylbenzotriazole can give rise to better results when combined with other compounds such as 2-mercaptobenzimidazole, 2-mercapto-5-aminothiadiazole, 2-mercapto-5-methyloxazole and diethylamine. Such fogging promoters are usually used in an amount between about 0.1 and about 15 g per liter of the developer.

There is not restriction on the developing agents which can be used in the present invention. Suitable examples are dihydroxybenzenes such as hydroquinone, methylhydroquinone, t-butylhydroquinone, etc., 3-pyrazolidones such as 1-phenyl-3-pyrazolidone, etc., aminophenols such as N-methyl-p-aminophenyl, etc., hydroxyamines, etc., and mixtures thereof. Black-and-white developing agents are generally suitable. The developer of the present invention has a pH of at least about 11.0, preferably 12 or more. A suitable concentration for the developing agent is about 10 to 100 g/l.

Suitable alkali used in the present invention include alkali metal hydroxides (for example, sodium hydroxide, potassium hydroxide, etc.), alkali metal carbonates (for example, sodium carbonate, potassium carbonate, etc.), alkali metal phosphates (for example, sodium dihydrogenphosphate, potassium phosphate, etc.), borates (for example, boric acid, sodium metaborate, borax, etc.), and mixtures thereof.

Protective antioxidants (preservatives) may also be used with the developer and are exemplified by sulfite salts such as sodium sulfite. Sodium sulfite, as an example, is used in an amount of about 5 to 40 g/l.

When a processing solution is coated on the surface of a photosensitive material (for example, the developer is spread between a photosensitive material and an image-receiving material), a thickening agent may be used to increase the viscosity of the processing solution. Suitable thickening agent includes hydrophilic polymers such as hydroxyethylcellulose, carboxymethylcellulose, etc.

Materials useful as the plastic support include polyesters such as poly(ethylene terephthalate), etc., polycarbonate, cellulose esters such as cellulose triacetate, cellulose propionate, cellulose diacetate, etc., a paper base laminated with polyethylene film can also be used.

The image-receiving layer used in a black-and-white diffusion transfer process is typically a dispersion of development nuclei in a binder. Binder materials for the image-receiving layer of the present invention are selected from those polymers which permit permeation by an alkaline solution. Examples are gelatin, poly(vinyl alcohol), polyvinylpyrrolidone, methylcellulose, carboxymethylcellulose, copolymers of maleic anhydride and vinyl acetate, etc. Development nuclei dispersed in the image-receiving layer comprise any of the following materials: colloids of heavy metals such as, for example, Zn, Hg, Fe, Ni, etc., colloids of noble metals such as Pd, Au, Pt, Ag, etc., heavy or noble metal sulfides which are sparingly soluble in water, selenium or tellurium compounds, etc. Image-receiving layers suitable for formation of black-and-white diffusion transfer images are described in U.S. Pat. Nos. 2,698,237, 2,698,245, 2,774,667 and Japanese Patent Publication No. 49411/76.

The diffusion transfer black-and-white photographic film units associated with the present invention comprising a plastic support, a silver halide photographic emulsion layer and an image-receiving layer, can be finished into products with various forms. For example, a photographic unit comprising a photosensitive element consisting of a transparent support and a silver halide emulsion coating thereon, and an image-receiving element consisting of another transparent support and an image-receiving layer provided thereon and imagewise exposed, and a developer is supplied between the emulsion coating layer and the image-receiving layer whereby a silver image is formed in the latter. Finally the two elements are separated (a peel-apart type film unit). Alternatively, an integral type unit can be used in which on a transparent supports are provided on both the image-receiving layer and the silver halide photographic emulsion layer in this or the reversed order. After imagewise exposure, a developer is fed into such an integral type film unit.

Hereinafter some practical examples will be explained for a better understanding but not for limiting the scope of the present invention.

EXAMPLE 1

On a transparent polyethylene terephthalate film support with a 200 micron thickness was coated a silver halide photographic emulsion which had been prepared by adding Compound (F-1) above as a foggant at a rate of 500 mg/mol Ag to an internal latent image type silver halide photographic emulsion produced in accordance with the method set forth in Example 1 of U.S. Pat. No. 4,040,839. In the photosensitive element thus produced the coating amount of silver halide was 4.4 g/m$^2$ (photosensitive element). Separately, an image-receiving element was produced by coating on a 200 micron thick transparent polyethylene terephthalate film support a coating mixture prepared in accordance with the formulation and the procedures set forth in Example 2 of Japanese Patent Publication No. 22950/69 (corresponding to U.S. Pat. No. 3,345,169) of nickel sulfide nuclei dispersed in a gelatin binder.

The photosensitive element was imagewise exposed and then brought into an intimate contact with the image-receiving element whereupon a developer having the following composition was uniformly spread.

| Developer Composition | |
|---|---|
| Methylhydroquinone | 3.2 g |
| 1-Phenyl-4-hydroxymethyl-4-methyl-3-pyrazolidone | 0.88 g |
| Potassium Hydroxide (28% aq. soln.) | 18.6 ml |
| Sodium Sulfite | 1.0 g |
| 5-Methylbenzotriazole | 0.4 g |
| N-(2-mercaptoethyl)-N,N-diethylamine | 20 mg |
| Diethylamine | 1 ml |
| Uracil | 1.0 g |
| Hydroxyethylcellulose | 2.25 g |
| Water | 20 ml |
| pH = 13.1 | |

After contact for 2 minutes at 25° C., the two elements were peeled apart and a clear and distinct black-and-white image comprising silver resulted in the image-receiving layer.

For the purpose of comparison, another photosensitive element was produced by coating on a polyethylene terephthalate film support a silver halide photographic emulsion which had been prepared by the method set forth in Example 1 of U.S. Pat. No. 3,367,778 and which was uniformly fogged at a rate of 4.5 g AgX/m$^2$. After imagewise exposure, this comparative element was brought into contact with the image-receiving layer prepared above and between the two elements was spread a developer with the composition described in Example 1 of U.S. Pat. No. 3,733,199 for 2 minutes at 25° C.

The resulting negative silver image had a photographic speed about 100 times slower than that for the preceding example of the present invention when measured at the density 0.5 above fog level.

EXAMPLE 2

On the image-receiving layer of the image-receiving element produced in Example 1 was provided a gelatin intermediate layer with a coating amount of 2 g/m$^2$, which was then overcoated with the internal latent image type silver halide emulsion set forth in Example 1. After the resulting diffusion transfer photographic film unit was imagewise exposed, the emulsion coating was brought into contact with a developer of the following composition.

| Developer Composition | |
|---|---|
| Compound (F-2) as foggant | 20 mg |
| Methylhydroquinone | 3.2 g |
| 1-Phenyl-4-hydroxymethyl-4-methyl-pyrazolidone | 0.88 g |
| Potassium Hydroxide (28% aq. soln.) | 18.6 ml |
| Sodium Sulfite | 1.0 g |
| 5-Methylbenzotriazole | 0.4 g |
| 1-Phenyl-5-mercaptotriazole | 25 mg |
| Diethylamine | 1 ml |
| Uracil | 1.0 g |
| Hydroxyethylcellulose | 2.25 g |
| Water | 20 ml |
| pH = 13.1 | |

After completion of development, the gelatin intermediate layer and the emulsion layer were removed by dissolving with 50° C. water whereby a sharp black-and-white image was obtained in the image-receiving layer.

COMPARATIVE EXAMPLE

A developer of the same composition as that used in Example 1 except that uracil was replaced with sodium thiosulfate the amount of which was varied between 0.5 and 2.0 g was expended between the exposed photosensitive layer and the image-receiving layer both of which are set forth in Example 1. After a developing period of 2 minutes at 25° C., the two elements were peeled apart. A black-and-white positive silver image with a considerable background resulted in lieu of a negative image in the image-receiving layer. This poor result is due to the use of sodium thiosulfate which is too strong a silver halide solvent to be within the scope of the present invention.

While the invention has been described in detail and with reference to specific embodiments thereof, it will be apparent to one skilled in the art that various changes and modifications can be made therein without departing from the spirit and scope thereof.

What is claimed is:

1. In a method of fogging black-and-white silver-containing negative images by a diffusion transfer photographic process using a black-and-white diffusion transfer photographic film unit comprising a plastic support, a silver halide photographic emulsion layer and an image-receiving layer which unit is imagewise exposed, the improvement which comprises subsequent processing in a single processing solution comprising a solvent for the silver halide, a foggant, a developing agent and a fogging promoting agent, whereby an optically negative image develops in said image-receiving layer, said silver halide photographic emulsion being an internal latent image type emulsion having no surface fog centers, and said silver halide solvent having a solubility for silver bromide as a 0.02 molar aqueous solution of about $2\times10^{-5}$ to 5 a $10^{-3}$ mol/l at 60° C. and at the developing pH.

2. The method of claim 1, wherein said internal latent image silver halide is a silver halide which provides a maximum density when developed at 20° C. for 3 minutes with Developer A defined in the specification which is more than 5 times greater than the maximum density obtained when developed at 20° C. for 4 minutes with Developer B defined in the specification.

3. The method of claim 1, wherein said silver halide solvent has a solubility for silver bromide when used as a 0.02 molar aqueous solution of about $5\times10^{-5}$ to $2\times10^{-3}$ mol/l at 60° C.

4. The method of claim 1, wherein said fogging promoting agent is selected from the group consisting of a triazole, an indazole, a triazaindolidine, an imidazole, an oxazole, a pyrimidine, a pyrazole, a pyrazolone, a thiazole, an amine and a thiadiazole.

5. The method of claim 4, wherein said fogging promoting agent comprises 5-methylbenzotriazole.

6. The method of claim 1, wherein said silver halide solvent is a thioether.

7. The method of claim 1, wherein said silver halide solvent is used in an amount of about 1 to 60 g/l.

8. The method of claim 1, wherein said developer is a dihydroxybenzene, a 3-pyrazolidone, an aminophenol, a hydroxyamine, or a mixture thereof.

9. The method of claim 8, wherein said developer is a dihydroxybenzene.

10. The method of claim 1, wherein said method is carried out in a peel-apart diffusion transfer photographic material.

11. The method of claim 1, wherein said method is carried out in an integral diffusion transfer photographic film unit.

* * * * *